US011211207B2

(12) United States Patent
Milan

(10) Patent No.: US 11,211,207 B2
(45) Date of Patent: Dec. 28, 2021

(54) ARCHITECTURE FOR AN ELECTRICAL SWITCHING DEVICE

(71) Applicant: Schneider Electric Industries SAS, Rueil Malmaison (FR)

(72) Inventor: Thierry Milan, Varces (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/922,164

(22) Filed: Jul. 7, 2020

(65) Prior Publication Data

US 2021/0020387 A1 Jan. 21, 2021

(30) Foreign Application Priority Data

Jul. 17, 2019 (FR) ..... 1908092

(51) Int. Cl.
*H01H 3/32* (2006.01)
*H01H 9/00* (2006.01)
*H01H 9/02* (2006.01)

(52) U.S. Cl.
CPC ..... *H01H 9/0072* (2013.01); *H01H 3/32* (2013.01); *H01H 9/02* (2013.01)

(58) Field of Classification Search
CPC ..... H01H 9/0072; H01H 9/02; H01H 3/32; H01H 33/022; H01H 33/42; H01H 33/52; H01H 33/666; H01H 2033/6665; H01H 71/02; H02B 11/127; H02B 11/20; H02B 13/0352
USPC ..... 200/48 R, 137, 293; 218/134, 139, 155, 218/44
See application file for complete search history.

(56) References Cited

U.S. PATENT DOCUMENTS 3,582,589 A * 6/1971 Frink ..... H01H 33/882 218/57
5,015,809 A * 5/1991 Wuthrich ..... H01H 33/022 218/119
6,198,062 B1 3/2001 Mather et al.
6,759,617 B2 * 7/2004 Yoon ..... H01H 33/666 218/120

(Continued)

FOREIGN PATENT DOCUMENTS

EP 1496535 1/2005
EP 2437277 4/2012

OTHER PUBLICATIONS

Search Report and Written Opinion for French Patent Application No. FR1908092 dated Apr. 1, 2020, 8 pages.

*Primary Examiner* — William A Bolton
(74) *Attorney, Agent, or Firm* — Locke Lord LLP

(57) ABSTRACT

A central module for a three-phase electrical switching device, comprising a central plinth intended to bear a central switch module and a front face comprising control/command members for the switching device. The central plinth comprises rear fixing means capable of fixing a rear plinth intended to bear two rear switch modules, lateral fixing means capable of fixing two lateral plinths intended to each bear a lateral switch module, an actuation mechanism intended to actuate a central switch module, and means for transmitting movements of the actuation mechanism toward the rear plinth and the lateral plinths to be able to actuate the rear and lateral switch modules. A three-phase electrical switching device comprising such a central module is also disclosed.

12 Claims, 4 Drawing Sheets

(56) References Cited

U.S. PATENT DOCUMENTS

| | | | | |
|---|---|---|---|---|
| 8,440,930 | B2 * | 5/2013 | Lee | H01H 3/46 218/140 |
| 8,629,366 | B2 * | 1/2014 | Reuber | H01H 33/66207 218/44 |
| 2015/0332883 | A1 * | 11/2015 | Benke | H01H 33/6662 335/9 |

* cited by examiner

ARCHITECTURE FOR AN ELECTRICAL SWITCHING DEVICE

TECHNICAL FIELD OF THE INVENTION

The present invention relates to a three-phase electrical switching device having a modular architecture, in particular a switching device operating at medium or high voltage, that is to say operating at a voltage higher than 1000 V. The invention relates also to a central module of such a switching device.

In the present document, the term "switching device" encompasses without distinction several types of electrical devices such as a switch, a circuit breaker, a contactor, a fuse switch, a recloser, a disconnector, etc.

STATE OF THE ART

The three-phase switching devices generally exist either with a so-called front-end architecture in which the three poles of the device are placed alongside one another in a direction substantially parallel to the front face of the switching device, or with a so-called longitudinal architecture in which the three poles of the device are placed behind one another in a direction substantially at right angles to the front face of the switching device.

A front-end architecture is for example well suited to the constraints of the devices that are intended to be placed in so-called primary high-voltage cells, whereas a longitudinal architecture is for example well suited to the constraints of the devices that are placed in so-called secondary high-voltage cells which often have smaller dimensions.

Also, it is known that the distances to be observed between each phase of a switching device can be different depending on the rated voltage and on the rated current of use of the device, for obvious reasons of dielectric constraints linked to the voltage and of heating constraints due to the current.

The document EP2437277 describes an arrangement for a multi-phase high-voltage circuit breaker with front-end architecture and whose poles are mounted in such a way that the distance between poles can easily be set, for example by virtue of different types of intermediate connection members between the poles.

One of the aims of the invention is to be able to rationalize the production and the industrial management of the switching devices, that is to say to be capable of very easily producing devices according to one or other of the architectures and according to different ratings and voltages by using the minimum of different parts, so as to reduce the costs and to simplify the production process.

For that, the switching device according to the invention is designed according to a modular architecture by making maximum use of the standardized modules according to the use planned by the clients, which therefore makes it possible to implement, as late as possible in the device production and assembly chain, a customization of the architecture and the choice of current and voltage of the switching device.

SUMMARY OF THE INVENTION

The invention describes a central module for a three-phase electrical switching device, the central module comprising a central plinth intended to bear a central switch module and a front face comprising control/command members for the switching device. The central plinth comprises:

rear fixing means placed at the rear of the central plinth and capable of fixing, removably to the central module, a rear plinth intended to bear two rear switch modules, lateral fixing means placed on each side of the central plinth and capable of fixing, removably to the central module, two lateral plinths intended to each bear a lateral switch module, an actuation mechanism intended to actuate the central switch module of the switching device, means for transmitting movements of the actuation mechanism to the rear plinth and lateral plinths when the latter are fixed to the central module, to be able to actuate other switch modules of the switching device.

According to a feature, to pass on the means of transmitting the movements of the actuation mechanism to other switch modules, the rear fixing means comprise a rear hatch placed at the rear of the central plinth and the lateral fixing means comprise two lateral hatches placed on each side of the central plinth.

The invention also describes a first type of three-phase electrical switching device comprising a central module with a central switch module borne by the central plinth, and comprising two lateral plinths fixed laterally on each side of the central plinth, each lateral plinth bearing a lateral switch module, the central switch module and the lateral switch modules being able to be actuated by the actuation mechanism of the central module.

According to a feature, the central switch module and the lateral switch modules are arranged so that the switching device has identical distances between phases. According to another feature, the central switch module and the two lateral switch modules are identical. According to another feature, the central switch module and the lateral switch modules are each topped by an identical height booster. According to another feature, the two lateral plinths each comprise two wheels placed on an outer side.

The invention also describes a second type of three-phase electrical switching device comprising a central module with a central switch module borne by the central plinth, and comprising a rear plinth fixed to the rear of the central plinth, the rear plinth bearing two rear switch modules, the central switch module and the rear switch modules being able to be actuated by the actuation mechanism of the central module.

According to a feature, the central switch module and the rear switch modules are arranged so that the switching device has identical distances between phases. According to another feature, the central switch module and the two rear switch modules are identical. According to another feature, the central switch module and the rear switch modules are each topped by an identical height booster. According to another feature, the rear plinth comprises two wheels placed on each of the lateral sides of the rear plinth.

BRIEF DESCRIPTION OF THE FIGURES

Other features will emerge from the following detailed description given in light of the attached drawings in which.

DETAILED DESCRIPTION

An electrical switching device of modular construction has a switch module for each phase of an electrical power supply network. In the case of a three-phase device, there are therefore three switch modules. Conventionally, each switch module is capable of cutting a phase of the electrical power supply network by virtue of one (or possibly several) mobile contact or contacts which cooperate with one (or several) fixed contacts. In the so-called open position, the mobile contact is separated from the fixed contact, and in the so-called closed position, the mobile contact is connected to the fixed contact. The actuation of the mobile contacts of the different switch modules of a switching device must be performed in a mechanically synchronized manner to ensure, for example, the simultaneous switching of all phases of the electrical power supply network, both on opening and on closing.

Figure 1:
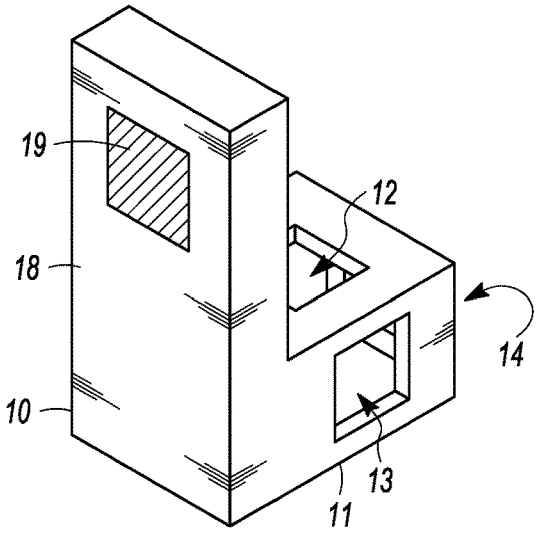
FIG. 1 shows a central module for a switching device according to the invention.

FIG. 1 shows a central module 10 which is intended for a switching device of modular design. This central module 10 comprises a basic central plinth 11 (or base 11) which is topped by a front face 18. The front face 18 notably comprises various control/command members 19 which, for example, allow an operator to control and monitor the switching device. The central plinth 11 is intended to bear a first switch module, called central switch module 15 (see FIGS. 2 and 3).

The central plinth 11 also comprises a central actuation mechanism which is intended to actuate the central switch module 15 of the switching device, that is to say to displace the mobile contract of the central switch module 15 from the closed position to the open position. For that, the central plinth 11 comprises a central window 12 so that the actuation mechanism can access and mechanically control the mobile contact of the central switch module 15 using conventional mechanical means, such as control rods, connecting rods, pivots and/or gears that are not represented in the figures, but of which an example is described notably in the document EP1968088.

The central module 10 can also comprise a control device which, linked notably with the control/command members 19 of the front face 18 and/or with remote control/command members, is responsible for driving the central actuation mechanism and for monitoring the operation of the switching device.

Figure 2:
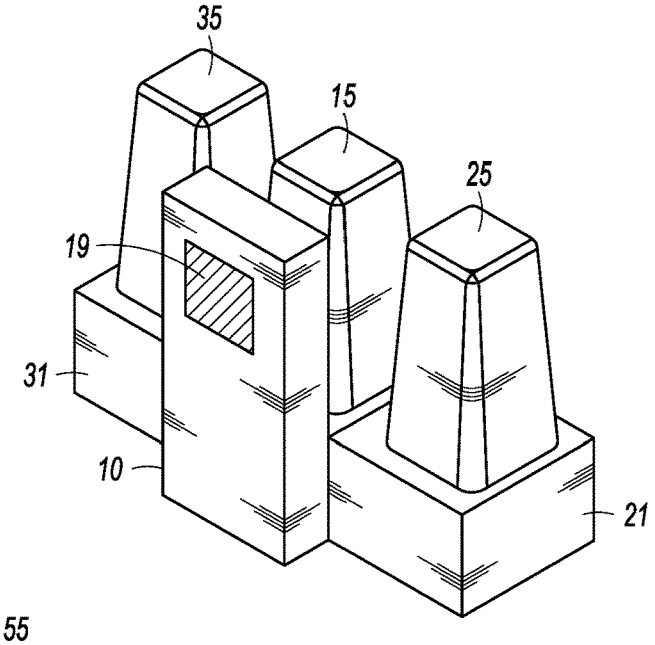
FIG. 2 represents a switching device having a front-end architecture and using a central module according to FIG. 1.
Figure 3:
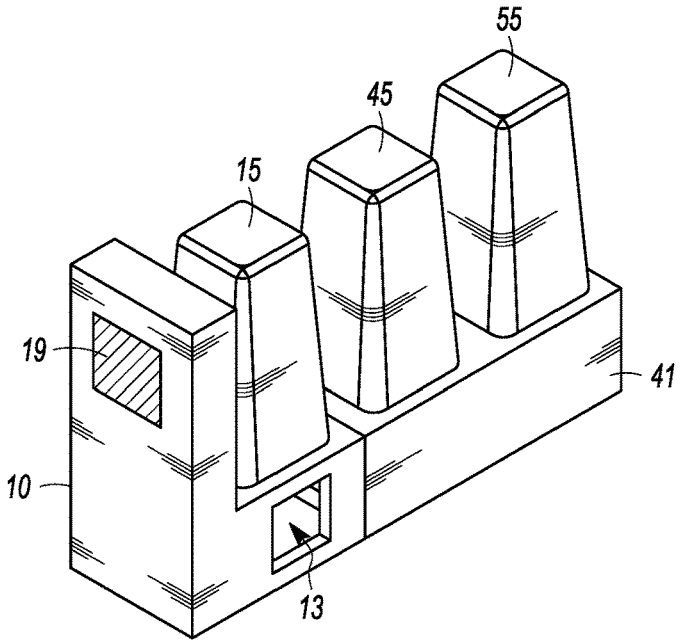
FIG. 3 represents a switching device having a longitudinal architecture and using a central module according to FIG. 1, FIGS. 4*a* and 4*b* detail two examples of a lateral plinth that can be connected to the central module for different ratings, FIGS. 5*a* and 5*b* detail two examples of a rear plinth that can be connected to the central module for different ratings.

Referring to FIGS. 2 and 3, the central plinth 11 comprises rear fixing means which are placed at the rear of the central plinth 11 and which are advantageously capable of removably fixing a rear plinth 41 to the central module 10, and lateral fixing means placed on each side of the central plinth 11 and which are capable of removably fixing two lateral plinths 21, 31 to the central module. These fixing means are not detailed in the present document and can notably comprise screws and nuts. For the actuation mechanism to be able to access the lateral plinths 21, 31 and the rear plinth 41 in order to control the mobile contacts, the rear fixing means comprise a rear hatch 14 placed at the rear of the central plinth 11 and the lateral fixing means comprise two lateral hatches 13 placed on each side of the central plinth 11.

By virtue of the invention, one and the same central module 10 can advantageously be used regardless of the architecture of the switching device, that is to say both in a front-end architecture represented in FIG. 2, and in a longitudinal architecture represented in FIG. 3. Furthermore, the actuation mechanism of this central module 10 is capable of controlling the mobile contacts of all the switch modules of the device.

Thus, FIG. 2 shows a switching device having a front-end architecture. It comprises two lateral plinths 21, 31 which are fixed laterally on each side of the central plinth 11 of the central module 10. The central plinth 11 bears a central switch module 15 and each lateral plinth 21, 31 bears a lateral switch module 25, 35. The central switch module 15 and the lateral switch modules 25, 35 are identical and can be actuated by the actuation mechanism of the central module. The two lateral hatches 13 present on each side of the central plinth 11 are placed facing a corresponding hatch 23 (see FIGS. 4*a*, 4*b*) on each lateral plinth. Each lateral plinth 21, 31 also comprises a window 22 (see FIGS. 4*a*, 4*b*) for the actuation mechanism to be able to access the lateral switch module 25, 35. The lateral modules 21 and 31 are symmetrical relative to a vertical longitudinal plane of the device.

Likewise, FIG. 3 shows a switching device having a longitudinal architecture. It comprises a rear plinth 41 which is fixed to the rear of the central plinth 11. The central plinth 11 bears a central switch module 15 and the rear plinth 41 bears two rear switch modules 45, 55. The central switch module 15 and the rear switch modules 45, 55 are identical and can be actuated by the actuation mechanism of the central module. The rear hatch 14 present at the rear of the central plinth 11 is placed facing a corresponding hatch 44 (see FIGS. 5*a*, 5*b*) on the rear plinth 41. The rear plinth 41 also comprises two windows 42, 52 (see FIGS. 5*a*, 5*b*) to access the two rear switch modules 45, 55.

To sum up, the hatches 13, 14, 23, 44 of the central plinth and the lateral/rear plinths then the windows 12, 22, 42, 52 have openings that are sufficient to transmit the movements of the central actuation mechanism to the lateral/rear plinths, then to the mobile contacts of the different switch modules. No electrical link is necessary between the central plinth 11 and the lateral/rear plinths 21, 31, 41, which makes the solution very simple to implement. The central plinth 11 must simply comprise means for transmitting movements of the actuation mechanism to the rear plinth 41 and the lateral plinths 21, 31, when a rear plinth 41 or two lateral plinths 21, 31 are fixed to the central module 10, to be able to actuate the other switch modules 25, 35, 45, of the switching device using conventional mechanical members such as, for example, control rods, connecting rods, pivots and/or gears.

Moreover, all the switch modules of the switching device are fixed removably to their respective plinth. Thus, the central switch module 15 is fixed removably to the central plinth 11 of the central module 10, the rear switch modules 45, 55 are fixed removably to the rear plinth 41 and the lateral switch modules 25, 35 are fixed removably to their respective lateral plinth 21, 31, which notably makes it possible to easily replace a switch module.

In the architecture of FIG. 3, it will be noted that the lateral hatches 13 on each side of the central plinth 11 are present but are not used because there is no lateral plinth 21, 31 fixed to the central plinth 11. Likewise, in the architecture of FIG. 2, the rear hatch 14 of the central plinth 11 is present but is not used because there is no rear plinth 41 fixed to the central plinth 11. To mask them, a tight cover can then perfectly well be placed on the various unused hatches.

According to a preferred embodiment, the invention provides several types of lateral plinth and rear plinth which can be used with one and the same unchanging central plinth 10, so as to be able to construct switching devices of different ratings (that is to say working at different rated currents) for example from 630 A to 3150 A.

Figure 5A:
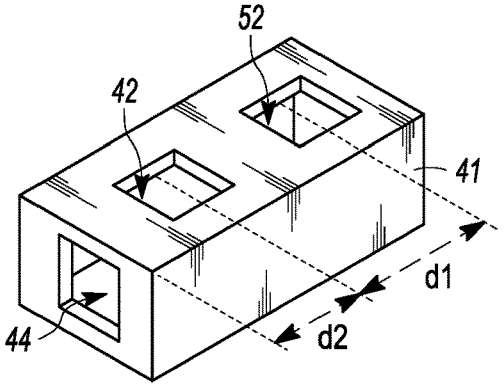
Figure 5B:
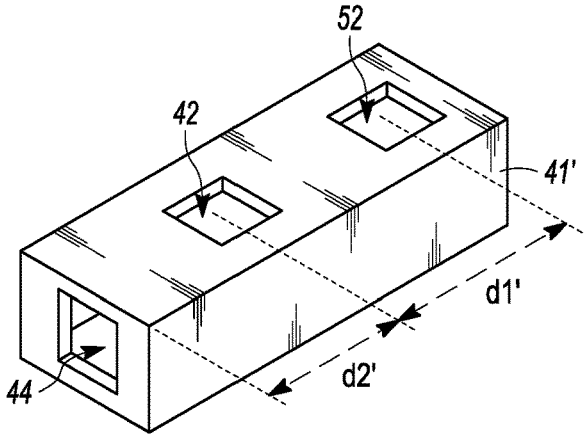

It can thus be seen in FIG. 5*a*, respectively 5*b*, that the two rear plinths 41, respectively 41', have different distances d1, respectively d1', between the axes of the two windows 42, 52. Likewise, the rear plinths 41, respectively 41', have different distances d2, respectively d2', between the axis of their first window 42 and the rim of the side having the hatch 44.

Therefore, depending on whether a central module 10 is used with a rear plinth 41 or a rear plinth 41', the switching device will have a different distance between phases. By virtue of that, one and the same central plinth 10 can serve as a basis for the construction of several switching device ratings, for example a rear plinth of type 41 for the 630 A and 1250 A ratings, or a rear plinth of type 41' for the rating ranging up to 3150 A, associated with switch modules 15, 45, 55 of different ratings.

The distances d1, d2 and d1', d2' are of course arranged so that the distances between phases of a device are identical, that is to say that the distances between, on the one hand, the switch modules 45 and 55 and, on the other hand, the switch modules 45 and 15, are identical.

Figure 4A:
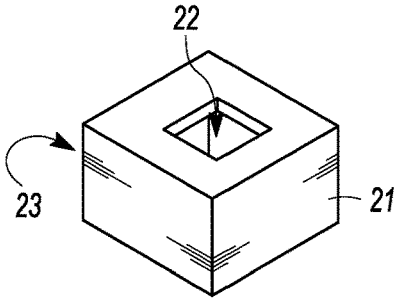
Figure 4B:
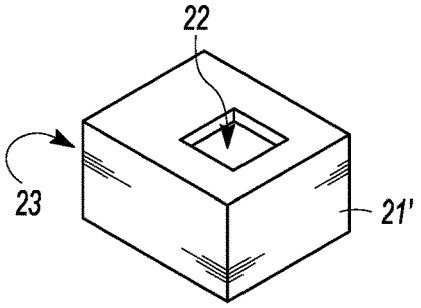

This feature also applies in the case of a front-end architecture with the possibility of adding different sizes of lateral modules 21, 31 to the central module 10. FIGS. 4*a*, 4*b* thus show lateral modules 21, respectively 21', which differ by the distance between their window 22 and the rim of the side having the hatch 23. This makes it possible to have a greater distance between phases in the case of the lateral modules 21'. By virtue of that, one and the same central plinth 10 can serve as a basis for the construction of several switching device ratings, for example lateral plinths of type 21 for the 630 A and 1250 A ratings, and lateral plinths of type 21' for the ratings up to 3150 A, associated with switch modules 15, 25, 35 of different ratings.

Figure 6:
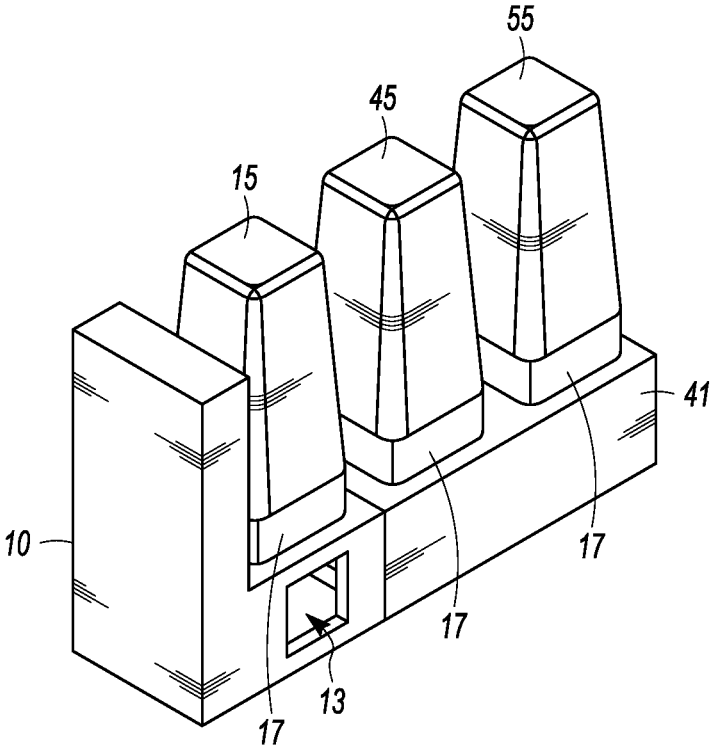
FIG. 6 shows the switching device of FIG. 3 with height boosters for the switch modules, FIGS. 7 and 8 take up FIGS. 2 and 3 in a detachable version.

According to another preferred feature, the invention also allows the possibility of easily adding a height booster 17 between each plinth and its associated switch module. Topping a switch module with respect to its plinth advantageously makes it possible to withstand higher nominal voltages, while not increasing the dielectric constraints. FIG. 6 thus shows the switching device of FIG. 3 in which a height booster 17 has been added for each switch module 15, 35, 45. Obviously, a similar height booster could have been added in the example of FIG. 2.

Such a height booster can for example have a height of approximately 80 to 100 mm with an elastomer part to ensure the sealing of the poles. It is used for example to be able to change from a nominal voltage of 17.5 kV to 24 kV.

Advantageously, these two features can be used independently of one another, namely using a height booster to withstand a higher nominal voltage and/or using lateral/rear plinths with greater distances between phases to withstand a higher nominal current.

Figure 7:
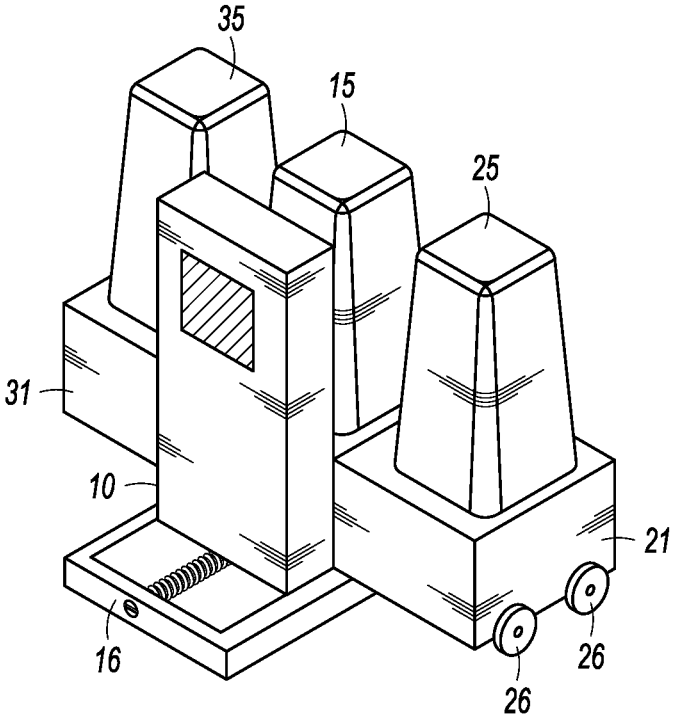
Figure 8:
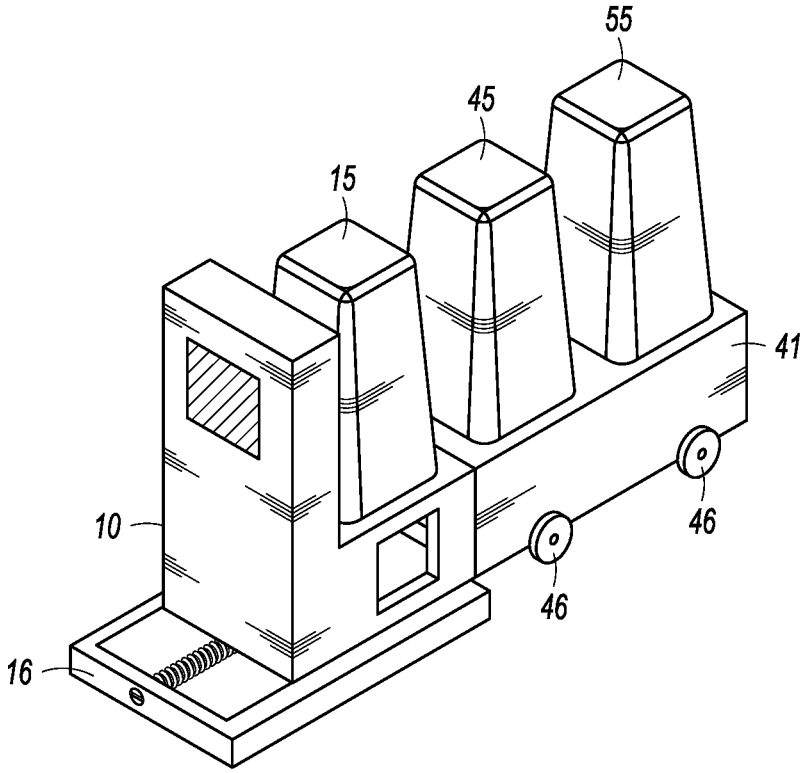

FIGS. 7 and 8 show a detachable version of the invention in the two architectures presented. A central module is in fact intended to be placed on a mobile truck so as to be able to approach then electrically connect the switching device inside a high-voltage cell. The mobile truck is translationally mobile to be able to approach the switching device and also comprises a conventional driving means, for example a worm screw motorized or actuated by a crank handle for the connection of the switching device. Usually, a mobile truck comprises a deck on which the switching device is fixed and whose dimensions are therefore matched to that switching device. The deck comprises, for example, wheels to be able to displace the truck easily.

Now, in the case of the modular architecture of the invention, it is more difficult to predict and adapt the dimensions of such a deck given the different footprints of the switching device according to the architecture selected on assembly. That is why a mobile truck 16 is directly fixed under the central module 10 of the switching device but, given that either two lateral plinths 21, 31, or one rear plinth 41, are assembled to the central plinth 11 of the central module, the stability and the correct displacement of the switching device need to be assured. For that, the invention provides, in the context of the longitudinal architecture of FIG. 8, the ability to add two wheels 46 which are placed on each of the lateral sides of the rear plinth 41. Likewise, in the context of the front-end architecture of FIG. 7, the invention provides the ability to add two wheels 26 which are placed on the outer side of the lateral plinth 21 (that is to say on the lateral side not fixed to the central plinth 11) and two wheels on the outer side of the lateral plinth 31 (not represented). Thus, in both architectures, there are four wheels which facilitate the displacement of the truck 16 and of the switching device and ensure the stability of the assembly. They can for example be guided in rails present in the high-voltage cell. These different wheels are easily mounted on the plinths during the assembly of the switching device.

The invention claimed is:

1. A central module for a three-phase electrical switching device, the central module comprising a central plinth intended to support a central switch module and a front face comprising control/command members for the switching device, wherein the central plinth comprises:

rear fixing means placed at a rear of the central plinth and capable of fixing, removably to the central module, a rear plinth intended to bear two rear switch modules, lateral fixing means placed on each side of the central plinth and capable of fixing, removably to the central module, two lateral plinths intended to each bear a lateral switch module, an actuation mechanism intended to actuate the central switch module of the switching device, and means for transmitting movements of the actuation mechanism to the rear plinth and side plinths when the rear plinth and the side plinths are fixed to the central module, to be able to actuate other switch modules of the switching device.

2. The central module according to claim 1, wherein, to pass on the means of transmission of the movements of the actuation mechanism to other switch modules, the rear fixing means comprise a rear hatch placed at the rear of the central plinth and the lateral fixing means comprise two lateral hatches placed on each side of the central plinth.

3. A three-phase electrical switching device comprising the central module according to claim 1, with the central switch module borne by the central plinth, and comprising two lateral plinths fixed laterally on each side of the central plinth, each lateral plinth bearing the lateral switch module, the central switch module and the lateral switch modules being able to be actuated by the actuation mechanism of the central module.

4. The three-phase electrical switching device according to claim 3, wherein the central switch module and the lateral switch modules are arranged so that the switching device has identical distances between phases.

5. The three-phase electrical switching device according to claim 3, wherein the central switch module and the two lateral switch modules are identical.

6. The three-phase electrical switching device according to claim 3, wherein the central switch module and the lateral switch modules are each topped by an identical height booster.

7. The three-phase electrical switching device according to claim 3, wherein the two lateral plinths each comprise two wheels placed on an outer side.

8. A three-phase electrical switching device, comprising the central module according to claim 1, with the central switch module borne by the central plinth, and comprising the rear plinth fixed to the rear of the central plinth, the rear plinth bearing two rear switch modules, the central switch module and the rear switch modules being able to be actuated by the actuation mechanism of the central module.

9. The three-phase electrical switching device according to claim 8, wherein the central switch module and the rear switch modules are arranged so that the switching device has identical distances between phases.

10. The three-phase electrical switching device according to claim 8, wherein the central switch module and the two rear switch modules are identical.

11. The three-phase electrical switching device according to claim 8, wherein the central switch module and the rear switch modules are each topped by an identical height booster.

12. The three-phase electrical switching device according to claim 8, wherein the rear plinth comprises lateral sides and two wheels placed on each of the lateral sides of the rear plinth.

* * * * *